US005117656A

United States Patent [19]

Keck et al.

[11] Patent Number: 5,117,656

[45] Date of Patent: Jun. 2, 1992

[54] OUTDOOR UNIT FOR A CENTRAL SYSTEM FOR CONDITIONING AIR, ASSEMBLY FOR USE WITH A HOUSING OF SUCH UNIT, AND METHOD OF ASSEMBLING A BLOWER MOTOR TO A COVER FOR SUCH UNIT

[75] Inventors: Arthur C. Keck, Fort Wayne, Ind.; Darrell L. Zweerink, Springfield, Mo.

[73] Assignee: General Electric Company, Fort Wayne, Ind.

[21] Appl. No.: 512,376

[22] Filed: Apr. 23, 1990

[51] Int. Cl.[5] ..... F25B 39/04

[52] U.S. Cl. ..... 62/506; 62/507; 62/508; 417/360

[58] Field of Search ..... 62/506, 507, 508, 295, 62/297; 417/360, 423.15; 310/91; 29/240, 888.025, 408

[56] References Cited

U.S. PATENT DOCUMENTS

| | | | |
|---|---|---|---|
| 3,865,517 | 2/1975 | Simmons et al. | 62/507 X |
| 4,036,292 | 7/1977 | Hine, Jr. | 62/507 X |
| 4,191,245 | 3/1980 | Wendt et al. | 62/507 X |
| 4,392,525 | 7/1983 | O'Mara et al. | 62/507 X |
| 4,394,111 | 7/1983 | Wiese et al. | 417/360 |
| 4,502,291 | 3/1985 | Shelton et al. | 417/360 X |
| 4,538,967 | 9/1985 | Furukawa | 417/360 |
| 4,656,075 | 1/1986 | Drucker et al. | 62/507 |
| 4,723,419 | 2/1988 | Kessler et al. | 62/507 |
| 4,858,683 | 8/1989 | Beehler | 62/507 X |
| 4,898,518 | 2/1990 | Hubbard et al. | 417/360 |

*Primary Examiner*—Albert J. Makay
*Assistant Examiner*—Christopher Kilner
*Attorney, Agent, or Firm*—Ralph E. Krisher, Jr.

[57] ABSTRACT

A method of releasably securing a blower motor to a cover for a unit for conditioning air with the blower motor having at least one end frame and with the cover and the at least one end frame respectively including a set of means for interconnection in releasable engagement with each other, respectively. In practicing this method, the at least one end frame is positioned adjacent the cover, and the interconnecting means are respectively associated with each other. The blower motor is rotated relative to the cover, and the interconnecting means are respectively interconnected with each other upon the rotation of the blower motor thereby to releasably secure the blower motor to the cover. A lock screw is interlocked in engagement between the cover and the at least one end frame to obviate displacement of the interconnecting means from their respective interconnections in releasable engagement with each other.

An outdoor unit for a central system for conditioning air and an assembly for use with a housing of such unit are also disclosed.

48 Claims, 5 Drawing Sheets

OUTDOOR UNIT FOR A CENTRAL SYSTEM FOR CONDITIONING AIR, ASSEMBLY FOR USE WITH A HOUSING OF SUCH UNIT, AND METHOD OF ASSEMBLING A BLOWER MOTOR TO A COVER FOR SUCH UNIT

FIELD OF THE INVENTION

This application relates in general to central systems for conditioning air to be supplied to a preselected space and in particular to an outdoor unit for use in such central system, an assembly for use with a housing of such unit, and also to a method of assembling a blower motor to a housing cover of such unit.

BACKGROUND OF THE INVENTION

In the past, various different structural schemes have been employed in the construction or assembly of an outdoor unit of a central system for conditioning air adapted to be supplied to a preselected space to regulate the temperature of such preselected space. As utilized hereinafter, the terminology "outdoor unit" or "unit" is intended to encompass either an air cooled condensing unit or an air cooled split system heat pump unit both of which are respective components of the aforementioned central system for conditioning air.

In one of the past structural schemes for an outdoor unit, a blower motor was provided with a "seating" end frame and a "shaft" end frame which were positioned in engagement with the opposite ends of a housing or shell of the blower motor, and a set of extended thru-bolts were interconnected between the "seating" end frame and the "shaft" end frame to retain them against displacement from their respective engaged positions with the blower motor shell. The term extended thru-bolts designates those particular thru-bolts having a threaded end section which respectively extended exteriorly and axially beyond the "seating" end frame opposite the "shaft" end frame through which the motor shaft extended for driving connection with a fan.

When the blower motor was mounted or assembled to a cover of a housing or cabinet for one of the past outdoor units, the "seating" end frame of the blower motor was abutted against an interior or bottom face of the cover generally centrally thereof, and the threaded sections of the extended thru-bolts projected through a set of openings in the cover for receiving the threaded sections. To retain the blower motor in its assembled position on the cover, a set of acorn nuts or the like were threadedly received on the threaded sections of the extended thru-bolts and tightened into engagement with the exterior or upper face of the cover opposite the aforementioned bottom face thereof against which the "seating" end frame of the blower motor was abutted. With the blower motor so mounted to the cover, a fan was secured to the motor shaft adjacent the "shaft" end frame, and the cover was secured in place on the housing for the past outdoor unit with the fan disposed within the housing. Of course, when the blower motor was energized to rotate the fan, ambient air was drawn into the housing through grill work in at least some of the sides of the housing and circulated in heat exchange relation with the various components mounted within the housing, such as for instance a hermetic compressor and the coils of a condenser or the like. The circulated air was then discharged or expelled generally vertically or upwardly from the housing by the blower motor fan through grill work forming a part of the cover.

While the above discussed structural schemes for the past outdoor unit may have had some salient features, it is believed that one of the disadvantageous or undesirable features involved not only an excess number of parts required to mount the blower motor to the cover but also the labor to assemble such excess number of parts. Further, other disadvantageous or undesirable features of the structural schemes for the past outdoor unit are believed to be problems encountered with respect to damaged, bent or loose extended thru-bolts on the blower motor as well as defective or cross-threaded acorn nuts or the like for threaded engagement with the extended thru-bolts.

In another past structural scheme for one of the past outdoor units, the "seating" end frame of a blower motor which did not have extended thru-bolts was abutted against the interior or bottom face of a housing cover for the past outdoor unit, and four screws were driven through the cover into threaded engagement with the "seating" end frame thereby to mount the blower motor to the cover. One of the disadvantageous or undesirable features of this past structural scheme is believed to be that it was only a marginally "safe" design.

In still another past structural scheme for another of the past outdoor units, one of the legs of a plurality of generally L-shaped metallic brackets was secured to the interior or bottom face of a housing cover for such past outdoor unit, and the other of the legs of such L-shaped brackets extended or depended from the interior face of the cover. The "seating" end frame of a blower motor which did not have extended thru-bolts was disposed at least adjacent the interior face of the housing cover between the other legs of the L-shaped brackets, and a plurality of screws were passed through such other legs into threaded engagement with a shell or housing of the blower motor to which the "seating" end frame was mounted. Again, one of the disadvantageous or undesirable features of this past structural scheme is believed to be that it was also only a marginally "safe" design.

SUMMARY OF THE INVENTION

Among the several objects of the present invention may be noted the provision of an improved outdoor unit for a central system for conditioning air, the provision of improved assemblies for use with a housing of such unit and the provision of improved methods of assembling a blower motor to a housing cover for such unit which overcome at least some of the disadvantageous or undesirable features discussed hereinabove with respect to the prior art as well as other disadvantageous or undesirable features thereof; the provision of such improved unit, assemblies and methods in which integral parts of the blower motor and the housing cover are interconnected with each other to releasably secure or mount the blower motor to the housing cover; the provision of such improved unit, assemblies and methods in which the releasable securement of the blower motor to the housing cover may be quickly and efficiently achieved; the provision of such improved unit, assemblies and methods in which only a single locking screw is utilized to retain the blower motor and housing cover against displacement from the releasable securement thereof; the provision of such improved unit and one such improved assembly and method in which components integral with the blower motor and housing cover are utilized to retain the blower motor and housing cover against displacement from the releasable securement thereof; the provision of such improved unit, assemblies and methods which include means for suppressing vibrations which may be encountered upon the energization of the blower motor in its releasable securement to the housing cover; and the provision of such improved unit, assemblies and methods in which the components utilized therein are simplistic in design, easily assembled, and economically manufactured. These as well as other objects and advantageous features of the present invention will be in part apparent and in part pointed out hereinafter.

In general and in one form of the invention, a method is provided for releasably securing a blower motor to a housing cover for a unit for conditioning air. The blower motor includes at least one end frame, and the at least one end frame and the housing cover respectively include a set of means for interconnection in releasable engagement with each other. In the practice of this method, the at least one end frame is positioned at least adjacent the housing cover, and the interconnecting means are respectively associated with each other. The blower motor is rotated relative to the housing cover, and the interconnecting means are respectively interconnected in releasable engagement with each other in response to the rotation of the blower motor thereby to releasably secure the blower motor to the housing cover. The at least one end frame and the housing cover are interlocked to obviate displacement of the interconnecting means from their respective interconnections in releasable engagement with each other.

Further in general, an assembly is provided in one form of the invention for use with a cover for a unit for conditioning air. In this assembly, the cover has a set of stepped openings therein. A blower motor includes at least one end frame having a set of connector means respectively passed through the larger of the stepped openings into releasable engagement with the smaller of the stepped openings for releasably mounting the blower motor to the housing cover. Means is arranged to interlock the cover and the at least one end frame for retaining the connector means against displacement from their respective releasable engagements with the smaller stepped openings.

Still further and in general, an outdoor unit is provided in one form of the invention for use in a central system for conditioning air. Cabinet means is provided for enclosing a plurality of components of the unit and includes a cover. A blower motor comprising one of the components has at least one end frame and is releasably mounted to the cover. The at least one end frame and the cover respectively include means for interconnecting in releasable engagement with each other thereby to effect the releasable mounting of the blower motor to the cover, and means is provided for interlocking the at least one end frame and the cover thereby to retain the interconnecting means against displacement from their respective releasable engagements with each other.

BRIEF DESCRIPTION OF THE DRAWINGS

Corresponding reference characters refer to corresponding parts throughout the several views of the drawings.

The exemplifications set out herein illustrate the preferred embodiments of the present invention in one form thereof, and such exemplifications are not to be construed as limiting with respect to either the scope of the disclosure or the scope of the invention in any manner.

DETAILED DESCRIPTION OF THE PREFERRED EMBODIMENTS

Figure 1:
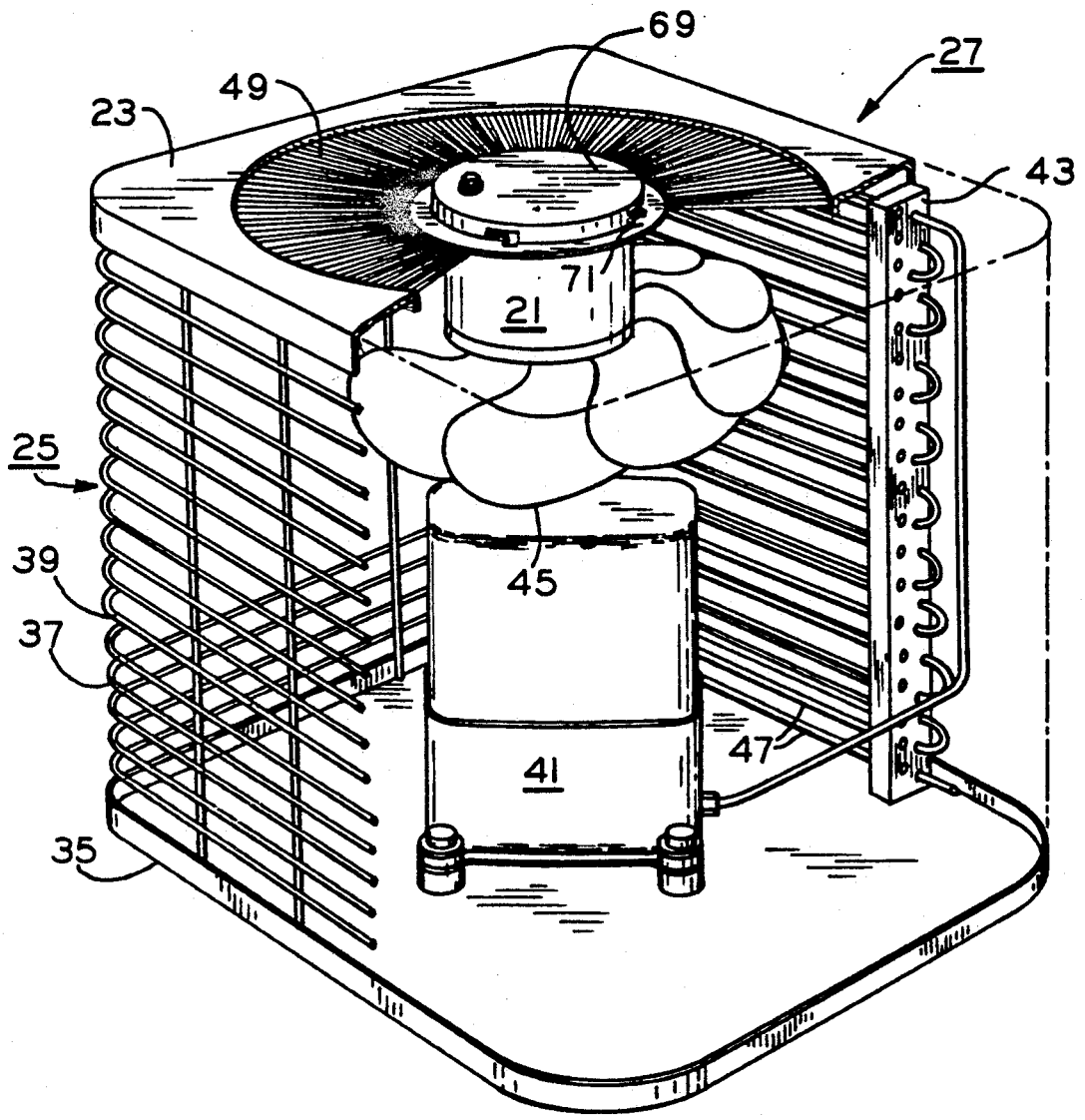
FIG. 1 is a perspective view of an outdoor unit in one form of the invention for a central system for conditioning air with the outdoor unit being partially broken away to illustrate an assembly of a blower motor with a cover for a housing of such unit also in one form of the invention.
Figure 2:
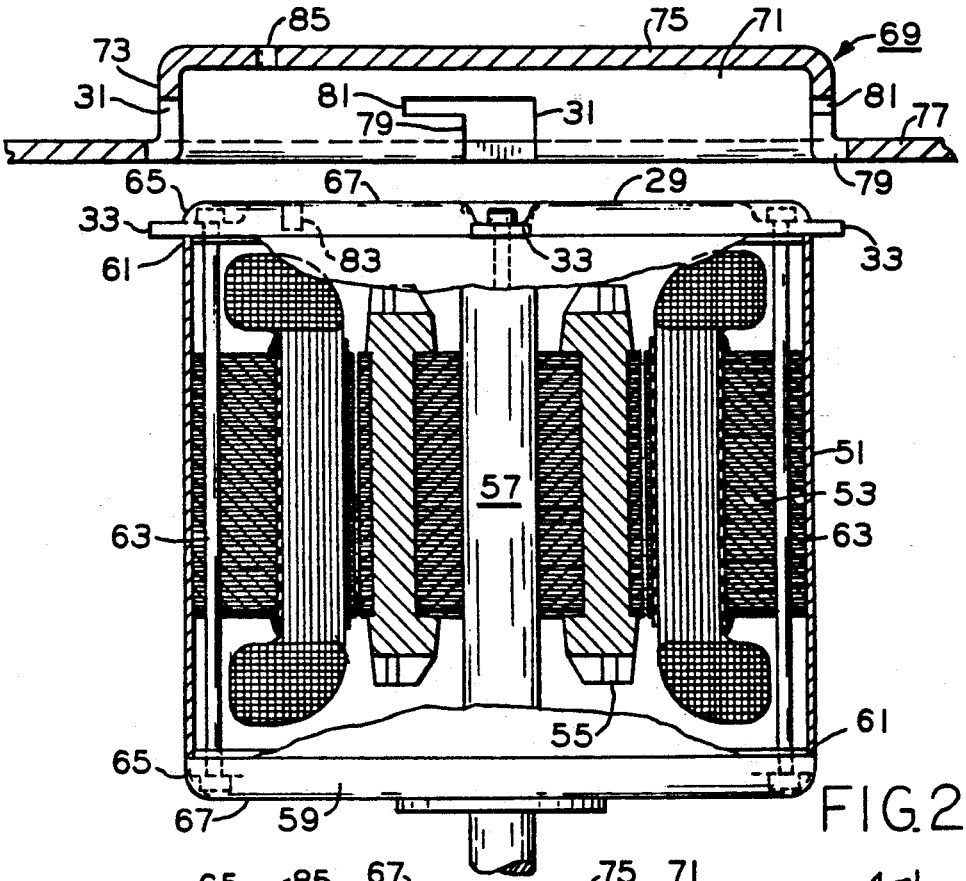
FIG. 2 is a partial sectional view illustrating principles which may be practiced in a method of assembling a blower motor to the cover for such unit in one form of the invention.
Figure 3:
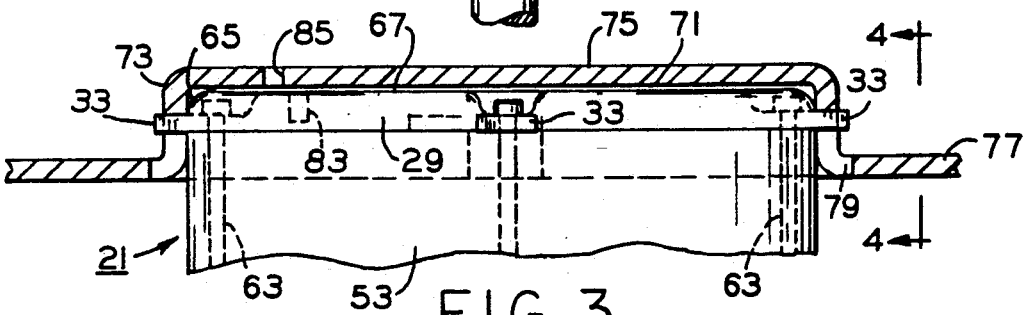
FIG. 3 is a partial sectional view similar to FIG. 2 and showing the blower motor partially assembled with the housing cover.
Figure 4:
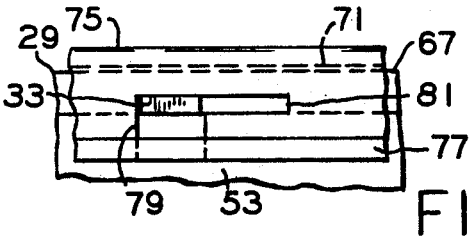
FIG. 4 is an enlarged partial elevational view taken along line 4—4 in FIG. 3.
Figure 7:
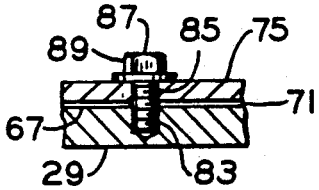
FIG. 7 is an enlarged sectional view taken along line 7—7 in FIG. 6.
Figure 5:
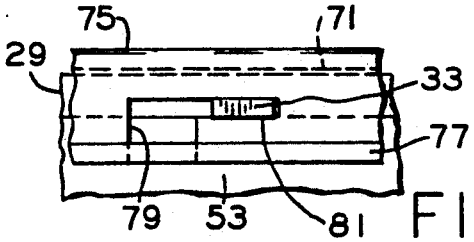
FIG. 5 is a partial elevational view similar to FIG. 4 and illustrating the releasable securement of the blower motor to the housing cover.
Figure 6:
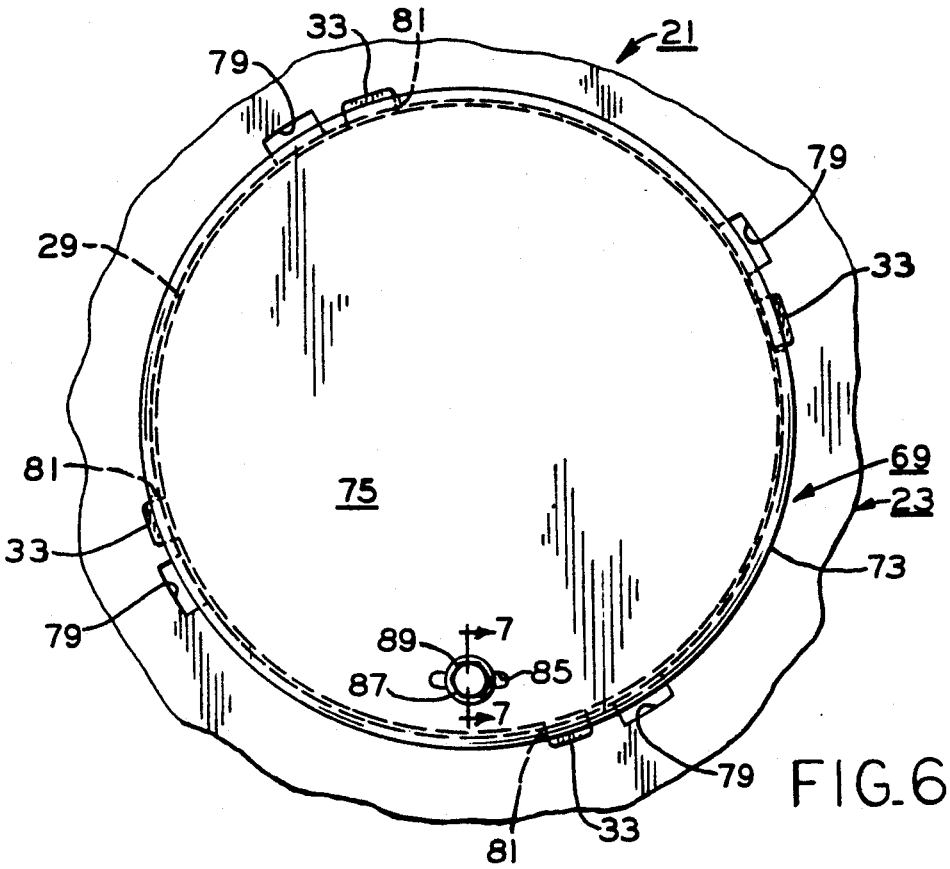
FIG. 6 is a partial top elevational view illustrating the releasable securement of the blower motor to the housing cover.

Referring now to the drawings in general, there is illustrated a method in one form of the invention for releasably securing a blower motor 21 to a cover 23 of a housing or cabinet 25 for an outdoor unit 27 of a central system (not shown) for thermally conditioning air (FIGS. 1-9). Blower motor 21 has at least one end frame 29, and cover 23 and end frame 29 respectively include a set of means 31, 33 for interconnection in releasable engagement with each other (FIGS. 2-6). In the practice of this method, end frame 29 is positioned or located at least adjacent cover 23, and upon such positioning of the end frame and cover, interconnecting means 31, 33 are respectively associated with each other (FIGS. 2–4). Blower motor 21 is rotated relative to cover 23, and in response to the blower motor rotation, inter connecting means 31, 33 are respectively interconnected in releasable engagement with each other thereby to releasably secure the blower motor to the cover (FIGS. 5 and 6). End frame 29 and cover 23 are interlocked to obviate displacement of interconnecting means 31, 33 from their respective interconnections in releasable engagement with each other (FIGS. 6 and 7).

More particularly and with specific reference to FIG. 1, outdoor unit 27 in one form of the invention is provided for a central system (not shown) adapted to deliver conditioned air to a preselected space, and as previously mentioned unit 27 may be either an air cooled condensing unit for a central air conditioning system of a type well known to the art (not shown) or an air cooled split system heat pump unit for a central air conditioning and heating system of a type well known to the art (not shown). Housing 25 of outdoor unit 27 has a base 35 on which a plurality of parts such as side panels 37 are secured or mounted, and at least some of the side panels may be formed at least in part of grills or grill work 39. A compressor 41 and a condenser 43 are supported on another part such as base 35 within housing 25, and when blower motor 21 is mounted to the part of the housing denoted as the cover 23, as discussed in detail hereinafter, the cover is releasably secured or mounted to side panels 37 generally opposite base 35 thereby to enclose the housing. When energized, blower motor 21 rotates a fan 45 which draws ambient air through grills 39 of at least some of side panels 37 into heat exchange relation with heat exchanging means shown in FIG. 1 as various components of unit 27 enclosed within housing 25, such as compressor 41 and a plurality of tubes or coils 47 of condenser 45 or the like for instance, and such air is then expelled or discharged from housing 25 generally vertically or upwardly through another grill or grill work 49 integral with cover 23. While outdoor unit 27 has other components, such as for instance various controls, wiring and plumbing or the like, such other components are omitted for the purposes of brevity of disclosure and drawing simplification.

As best seen in FIG. 2, blower motor 21 is provided with a generally annular shell or housing 51, and a stator 53 is secured to the shell so as to extend about a rotor 55. Winding means 56 carried by stator 53 is associated in magnetic coupling relation with rotor 55 upon the energization of blower motor 21. A shaft 57 carried by rotor 55 is suitably journaled in end frame 29 and another opposite end frame 59 by suitable bearing means well known to the art (not shown), and the shaft extends exteriorly of end frame 59 for driving fan 45 in the manner previously discussed to effect the circulation of ambient air through housing 25 of unit 27 in heat exchange relation with the components enclosed within the unit. Each end frame 29, 59 is provided with a generally annular rabbet 61 received in mounting engagement with the opposite ends of shell 51, and a plurality of thru-bolts 63 extend through the shell and the opposite end frames thereby to retain the opposite end frames against displacement from the shell. While end frames 29, 59 of blower motor 21 are disclosed herein as being retained against displacement from shell 51 by thru-bolts 63, it is contemplated that other blower motors employing various other constructions for retaining end frames against displacement from a shell may be utilized within the scope of the invention so as to meet at least some of the objects thereof. End frame 29 is further provided with a generally cylindric sidewall 65 extending between rabbet 61 and an end wall or end face 67 of the end frame, and it may be noted that a plurality of lugs or bayonet connectors comprising the aforementioned interconnecting means 33 are integrally formed with end frame sidewall 65 extending generally radially therebeyond. While lugs 33 are illustrated herein as being formed on sidewall 65 at least adjacent rabbet 61 of end frame 29, it is contemplated that such lugs may be predeterminately spaced from the rabbet within the scope of the invention so as to meet at least some of the objects thereof.

A deformed or distended section 69 is integrally provided in cover 23 generally centrally thereof, and the distended section defines an open ended recess 71 in the cover, as also seen in FIG. 2. Distended section 69 has a generally cylindric sidewall 73 integrally formed between an end wall 75 and a generally annular rim or part 77 of cover 23 extending about the sidewall and connected with grill 49 of the cover, as illustrated in FIG. 1, and the end wall is predeterminately spaced above or vertically beyond the annular rim of the cover. A set of stepped openings or slots 79, 81 which comprise the aforementioned interconnecting means 31 are provided at least in part in sidewall 73 of distended section 69 so as to communicate with open ended recess 71, and it may be noted that the larger stepped openings 79 extend in part through annular rim 77 of cover 23 adjacent sidewall 73.

When the blower motor 21 is positioned adjacent cover 23, as shown in FIG. 2, end frame 29 is arranged so as to be disposed at least adjacent open ended recess 71 of distended section 69 in the cover, and lugs 33 on end frame 29 are respectively located at least generally in alignment with larger stepped openings 79 in the cover. Upon the location of lugs 33 with respect to larger stepped openings 79, blower motor 21 is moved toward cover 23 into the position shown in FIG. 3 thereby to position or otherwise dispose end frame 29 of the blower motor at least in part within open ended recess 71 in the cover. With end frame 29 so entered into open ended recess 71, it may be noted that sidewall 65 and end wall 67 of the end frame are placed or arranged at least adjacent sidewall 73 and end wall 75 of distended section 69 in cover 23, respectively. Furthermore, when end frame 29 is moved into open ended recess 71, as discussed above, lugs 33 on the end frame are passed or inserted into larger stepped openings 79, as also illustrated in FIG. 4. Upon the aforementioned passage of lugs 33 into larger stepped openings 79, it also may be noted that the lugs are moved from adjacent one of the opposite faces of cover 23, through the part of larger stepped openings 79 in annular rim 77 and past the other of the opposite faces of the cover into the part of larger stepped openings 79 in sidewall 73 of distended section 69 in cover 23. Therefore, when lugs 33 are moved into the parts of larger stepped openings 79 in sidewall 73 of distended section 69, it may be further noted that parts of the lugs extend generally radially outwardly beyond the distended section sidewall.

When lugs 33 are disposed in larger stepped openings 79 as shown in FIGS. 3 and 4, blower motor 21 may be rotated relative to cover 23, and in response to this rotation of the blower motor, the lugs are displaced from the larger stepped openings into rotated positions within smaller stepped openings 81 in releasable engagement or interference fitting engagement therewith, respectively, as shown in FIG. 5. Smaller stepped openings 81 are provided with a slightly tapered configuration between the opposite ends thereof in order to insure the aforementioned interference fitting or releasable engagement between the smaller stepped openings and lugs 33 when the lugs are displaced into the smaller stepped openings in the manner discussed hereinabove. Upon the rotative displacement of lugs 33 into releasable engagement with smaller stepped openings 81, it may be noted that blower motor 21 is releasably secured or mounted to cover 23.

With blower motor 21 releasably secured to cover 23 in the manner discussed above, cover 23 and end frame 29 of the blower motor are then interlocked or interconnected to retain lugs 33 against displacement from their rotated positions in releasable engagement with smaller stepped openings 81. To achieve the interlock of cover 23 and end frame 29, an opening or hole 83 provided in end wall 67 of the end frame may be located generally in alignment with an elongate slot or opening 85 provided in end wall 75 of distended section 69 in the cover. When hole 83 and elongate slot 85 are so aligned with each other, a lock screw 87 may be inserted through the elongate slot into threaded engagement with hole 83, and a head portion 89 on the lock screw is abutted with end wall 75 of distended section 69 in cover 23 thereby to effect the aforementioned interlock of cover 23 and end frame 29 on blower motor 21.

Referring now to FIGS. 8–15, an alternative method is provided in one form of the invention for assembling a blower motor to a housing cover of a unit for conditioning air, and this alternative method utilizes generally the same components in generally the same manner as set out in the previously discussed method with the exceptions noted hereinafter. While this alternative method meets at least some of the objects set out hereinbefore, it is believed that such alternative method has indigenous objects and advantageous features which will be in part apparent and in part pointed out in the following discussion.

As best seen in FIGS. 8–11, a housing cover **23*a* for outdoor unit 27 is generally the same as the previously discussed housing cover 23 except that the central portion of cover 23*a* is generally flat or planar, and a set of stepped openings or slots 91 which respectively comprise the aforementioned interconnecting means 31 are provided generally in a circular array in the central portion of cover 23*a*. An end frame 29*a* is provided on blower motor 21 which is generally the same as the previously discussed end frame 29 except that end frame 29 has a set of flats 93 on end wall 67 with a set of bayonet connectors 95 respectively extending at least adjacent the flats generally axially beyond end wall 67, and bayonet connectors 95 respectively comprise the aforementioned interconnecting means 33**.

Figure 8:
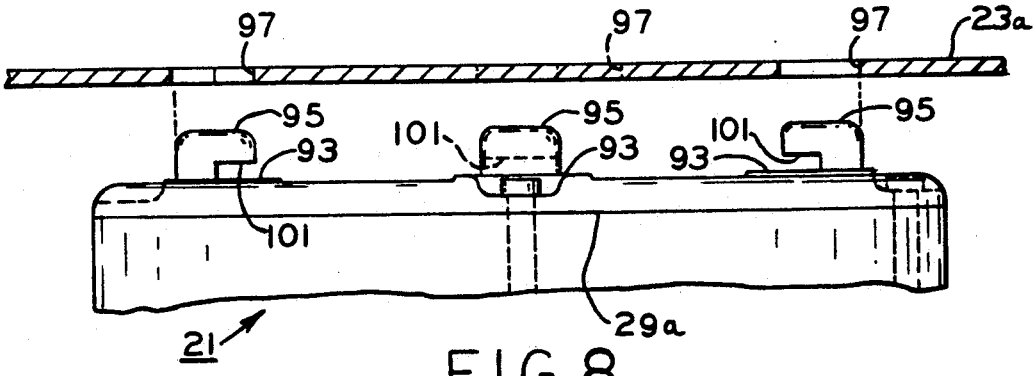
FIG. 8 is a partial sectional view illustrating principles which may be practiced in an alternative method of assembling a blower motor to a cover for such unit in one form of the invention.
Figure 9:
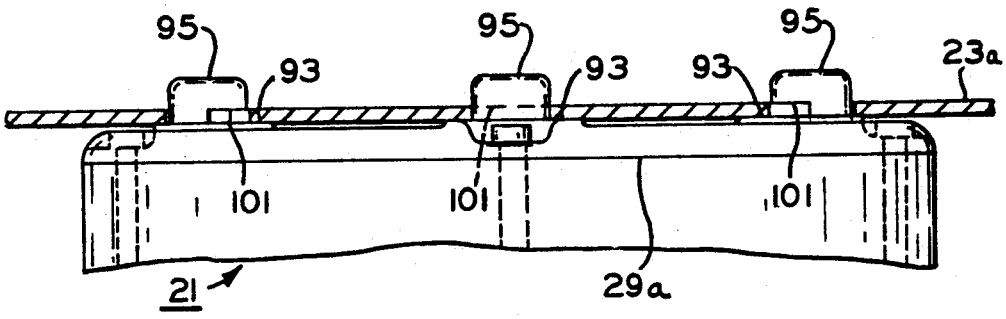
FIG. 9 is a partial sectional view similar to FIG. 8 and showing the blower motor partially assembled with the cover.

When blower motor 21 is positioned adjacent cover **23*a*, a shown in FIG. 8, bayonet connectors 95 are respectively located at least generally in alignment with the larger stepped opening 97 of stepped opening set 91 in the cover. Thereafter, blower motor 21 is moved toward cover 23*a* into the position shown in FIG. 9 thereby to pass or insert bayonet connectors 95 in part through the larger stepped openings 97 and to abut flats 93** against the cover generally about the larger stepped openings.

Figure 10:
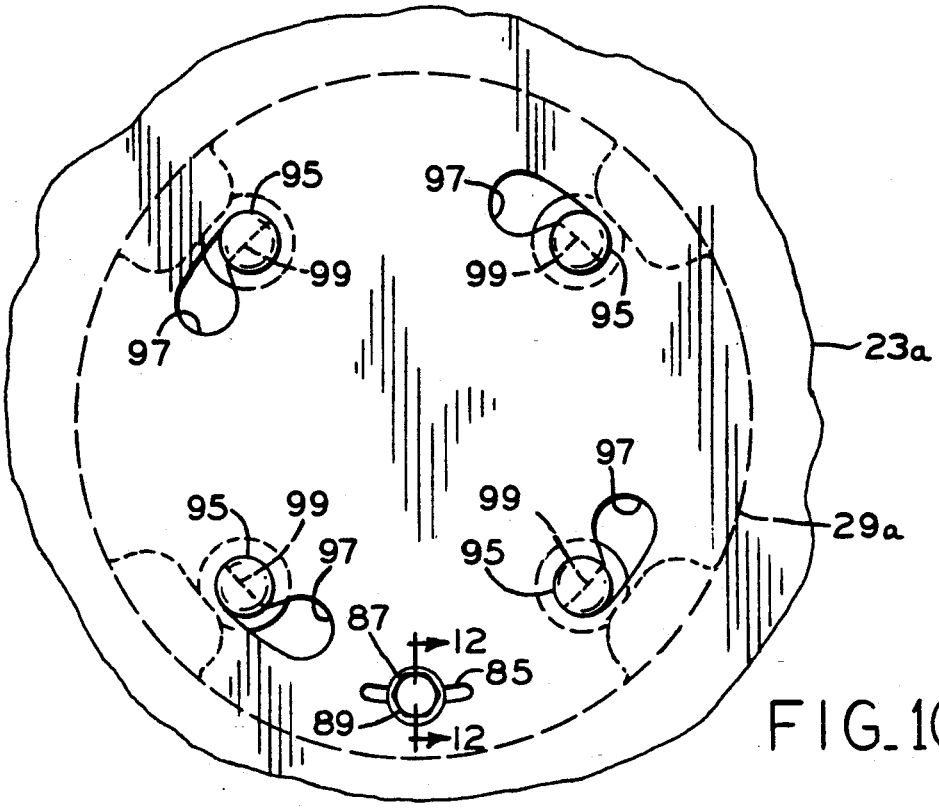
FIG. 10 is a top elevational view illustrating an alternative assembly of a blower motor to a cover for such unit in one form of the invention.
Figure 11:
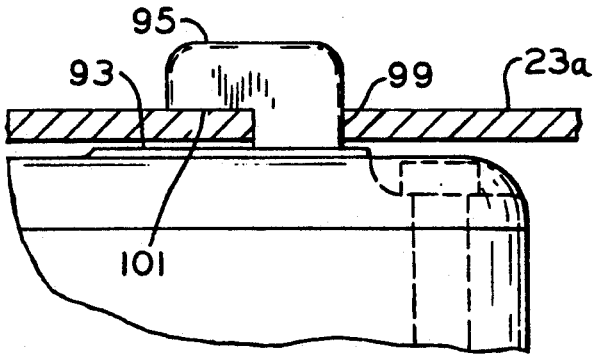
FIG. 11 is an enlarged partial sectional view taken along line 11—11 in FIG. 10.

Upon the passage of bayonet connectors 95 through larger stepped openings 97 in cover **23*a*, blower motor 21 may be manually rotated relative to cover 23*a*, and in response to this rotation of the blower motor, the bayonet connectors are displaced from the larger stepped openings into rotated positions within the smaller stepped opening 99 of stepped opening set 91 in releasable engagement or interference fitting engagement therewith, as best seen in FIGS. 10 and 11. Smaller stepped openings 99 are provided with a slightly tapered configuration between the opposite ends thereof to insure the aforementioned interference fitting or releasable engagement between the smaller stepped openings and bayonet connectors 95 when the bayonet connectors are displaced into their rotated positions within the smaller stepped openings in the manner discussed above. It may be noted that bayonet connectors 95 are provided with a set of lips 101 which extend in spaced apart and overlaying relation with flats 93, respectively. Therefore, when bayonet connectors 95 are displaced into their rotated positions in releasable engagement with smaller stepped openings 99, it may also be noted that the opposite sides of cover 23*a* adjacent smaller stepped openings are gripped in engagement between the flats 93 on end frame 29*a* and lips 101 on the bayonet connectors, respectively. Thus, the aforementioned gripping engagement of flats 93 and lips 101 with the opposite faces of cover 23*a* as well as the releasable engagement of the bayonet connectors with smaller stepped openings 99 serves to releasably secure or mount blower motor 21 to cover 23*a***.

Figure 12:
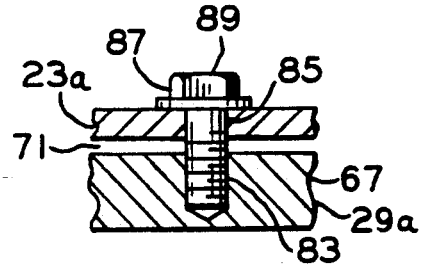
FIG. 12 is an enlarged sectional view taken along line 12—12 in FIG. 10.

With blower motor 21 releasably secured to cover **23*a* in the manner discussed above, cover 23*a* and end frame 29*a* of the blower motor are then interlocked or interconnected to retain bayonet connectors 95 against displacement from their rotated positions in releasable engagement with smaller stepped openings 99. This interlock of cover 23*a* and end frame 29*a* may be effected by inserting lock screw 87 through elongate slot 85 in cover 23*a* into threaded engagement with hole 83 in end frame 29*a* with head portion 89 of the lock screw abutted against cover 23*a* about the elongate slot therein, as best seen in FIGS. 10 and 12**.

Figure 13:
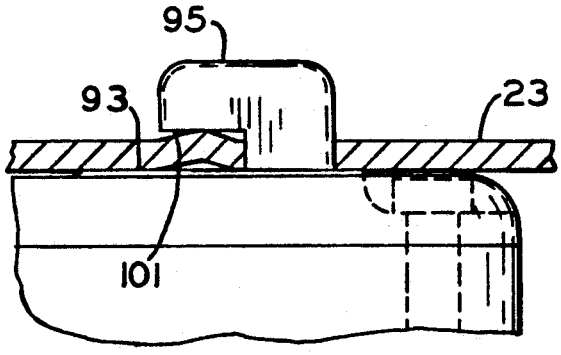
FIG. 13 is a partial elevational view illustrating an alternative construction which may be utilized in the housing cover of FIG. 8 in one form of the invention.

In FIG. 13, an alternative construction is illustrated in one form of the invention as a detent, crimp or fold 109 in cover **23*a* at least adjacent each smaller stepped opening 99. Thus, when bayonet connectors 95 are in their rotated positions in releasable engagement with smaller stepped openings 99, detents 109 are gripped in engagement with at least one of flats 93 on end frame 29*a* and lips 101 on the bayonet connectors, respectively. Thus, detents 109 are believed to intensify the above discussed respective gripping engagements of flats 93 and lips 101 with the opposite faces of cover 23*a* adjacent smaller stepped openings 99, and such intensified gripping engagements are believed to result in at least aiding the suppression of vibrations which may be effected between by the engagements of the lips and flats with the cover when blower motor 21 is energized in unit 27**, as previously discussed.

Figure 14:
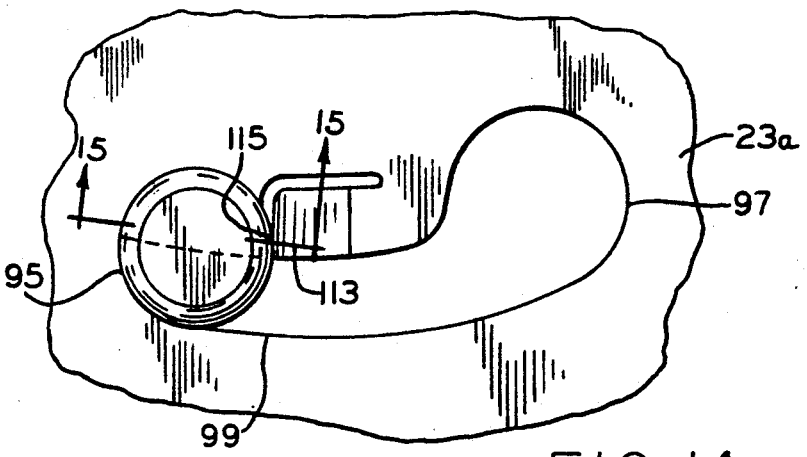
FIG. 14 is a partial sectional view illustrating still another alternative construction which may be utilized in the housing cover of FIG. 8 in one form of the invention.
Figure 15:
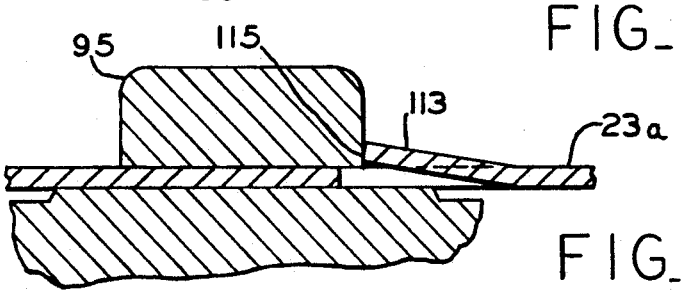
FIG. 15 is a sectional view taken along line 15—15 in FIG. 14.

In FIGS. 14 and 15, still another alternative construction is illustrated in one form of the invention as a locking finger or flange 113 lanced from cover 23 adjacent each smaller stepped opening 99. It may be noted that lanced locking fingers 113 are deformed at least in part so as to extend generally angularly with respect to the plane of cover 23*a*. Therefore, when bayonet connectors 95 are moved past lanced locking fingers 113 into their rotated positions in releasable engagement with smaller stepped openings 99, a distal or free end 115 on each lanced locking finger 113 is disposed for locking engagement with a part of an associated or cooperating bayonet connector thereby to obviate displacement of the bayonet connectors from their releasable engagements with the smaller stepped openings, respectively.

While stepped openings 31, 91 and bayonet connectors 33, 95 are disclosed as having the particular configurations discussed hereinabove, it is contemplated that other stepped openings and bayonet connectors having various different configurations may be utilized within the scope of the invention so as to meet at least some of the objects thereof.

Furthermore, it is also contemplated that the previously discussed distended section 69 may be provided in cover 23*a* for unit 27 with the generally circular array of stepped openings 91 extending through the end wall 75 of the distended section to cooperatively receive bayonet connectors 95 of end frame 29*a* on blower motor 21 in the manner discussed above and with end frame 29*a* disposed at least in part within the open ended recess 71 defined by the distended section in cover 23*a* within the scope of the invention so as to meet at least some of the objects thereof.

Figure 16:
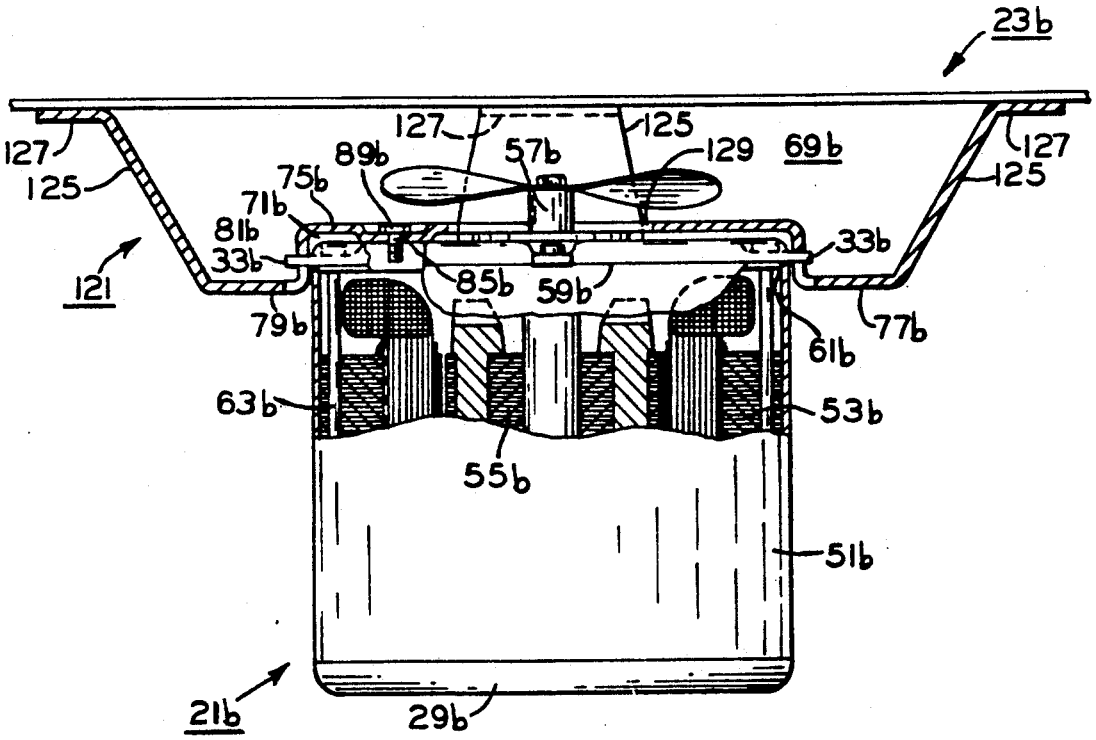
FIG. 16 is a partial sectional view showing in part one form of the invention, a still further alternative assembly of a blower motor to the cover of such alternative unit in one form of the invention, and illustrating principles which may be practiced in a still further alternative method of assembling a blower motor to such alternative unit also in one form of the invention.

With reference now to FIG. 16, a still further alternative assembly for use with housing 25 of unit 27 and a still further alternative method of assembling a blower motor to a cover 23*b* for such unit are disclosed in one form of the invention, respectively, and such alternative assembly and method utilize generally the same component parts assembled generally in the same manner as previously discussed with respect to cover 23 with the exceptions noted hereinafter. While this alternative assembly and method meet at least some of the objects set out hereinbefore, it is believed that this alternative assembly and method have indigenous objects and advantageous features which will be in part apparent and in part pointed out in the following discussion.

In the alternative assembly of FIG. 16, a mounting flange 121 is provided with a generally annular base or base wall 123 having a deformed or distended section 69*b*, and since distended section 69*b* has generally the same construction as the previously discussed distended section 69 of end frame 23, like parts of distended section 69*b* are designated by the letter "b" for the sake of brevity of disclosure. Distended section 69*a* defines an open ended recess 71*b* in annular base 123 of mounting flange 121 and has a generally cylindric sidewall 73*b* integrally interposed between an end wall 75*b* and a generally annular rim or part 77*b* of base 123 extending about the sidewall. A plurality of mounting arms 125 are respectively integrally formed in spaced relation generally circumferentially about base 123 of mounting flange 121, and a plurality of generally angularly extending free ends or free end portions 127 on the mounting arms are seated or abutted against the interior or bottom face of cover 23*b*, respectively. Free end portions 127 are respectively fixedly engaged or secured in their abutment positions with cover 23*b* by suitable means, such as for instance spot welds or the like (not shown), and in this manner, the fixed engagement of the mounting arms to the cover predeterminately spaces end wall 75*b* of distended section 69*b* from the interior face of the cover. Of course, larger and smaller stepped openings 79*b*, 81*b* which comprise interconnecting means 31*b* are provided in sidewall 73*b* of distended section 69*b* communicating with open ended recess 71*b*, and larger stepped openings 79*b* extend in part through annular rim 77*b* of base 123. It may be noted that a generally central opening 129 is provided through end wall 75*b* of distended section 69*b*, and elongate opening 85*b* extends through the end wall being spaced adjacent the central opening therein.

Since blower motor 21*b* as shown in FIG. 16 has generally the same construction as the previously discussed blower motor 21, like parts of blower motor 21*b* are hereinafter designated by the letter "b" for the sake of brevity of disclosure. It may be noted that bayonet connectors or interconnecting means 33*b* are integrally provided on end frame 59*b* of blower motor in the same manner that the previously described bayonet connectors 33 were provided on end frame 29 of blower motor 21. Thus, blower motor 21*b* is assembled in releasable securement or mounting engagement with distended section 69*a* of mounting bracket 121 in the same manner previously discussed with respect to the assembly of blower motor 21 with distended section 69 of cover 23 with the exception, of course, that the bayonet connectors 33*b* provided on end frame 59*b* of blower motor 21*b* are respectively received in releasable engagement within smaller stepped openings 81*b* in sidewall 73*a* of distended section 69*a* of mounting bracket 121. During the above discussed association of bayonet connectors 33*b* in releasable engagement with smaller stepped openings 81*b*, shaft 57*b* of blower motor 21*b* is passed through central opening 129 in end wall 75*b* of distended section 69*b* on mounting bracket 121, and fan 45 is drivingly connected or received on shaft 57*b* so as to be rotatable therewith between cover 23*b* and end wall 75*b* of distended section 69*b*.

In order to retain bayonet connectors 33*b* on end frame 59*b* of blower motor 21*b* against displacement from their respective rotated positions in releasable engagement with smaller stepped openings 81*b* in distended section 69 of mounting bracket 121, locking screw 87*b* is passed through elongate opening 85*b* in end wall 75*b* of the distended section into threaded engagement with opening 83*a* provided therefor in end wall 75*b*, and head portion 89*b* of locking screw 87*b* is disposed in abutment with end wall 75*b* so as to extend at least in part about elongate opening 85*a*. Thus, mounting bracket 121 and blower motor 121 are interlocked or interconnected against relative displacement by the above discussed interconnection of lock screw 87*b* between end wall 75*b* of distended section 69*b* on mounting bracket 121 and end frame 59*b* of blower motor 21*b*. When blower motor 21*b* is releasably secured to mounting bracket 121 of cover 23*b* in the manner discussed above, cover 23*b* may be mounted to the upper ends of such panels 37 of outdoor unit 27 in the same manner as previously discussed with respect to cover 23. Upon the above discussed mounting association of cover 23*b* with outdoor unit 27, it may be noted that blower motor 21*b* is disposed in a vertical shaft up position within the outdoor unit.

In view of the foregoing, it is now apparent that a novel outdoor unit for a central system for conditioning air, novel assemblies for use with a housing of such unit and novel methods of assembling a blower motor to a housing cover for such unit have been provided meeting at least the objects set out hereinabove, and it is contemplated that changes as to the precise arrangements, shapes and connections of the component parts utilized in such novel outdoor unit, assemblies and methods, as well as the precise order of the steps of such methods, may be made by those having ordinary skill in the art without departing from the spirit of the invention or from the scope of the invention as set out in the claims which follow.

What we claim as new and desire to secure by Letters Patent of the United States is:

1. A method of releasably securing a blower motor to a cover for a unit for conditioning air, the cover including a distended section with a generally cylindric sidewall integrally interposed between a portion of the cover adjacent the sidewall and an end wall on the distended section spaced beyond the cover portion, an elongate opening in the end wall, and a plurality of stepped slots with the larger of the stepped slots intersecting both the sidewall and the cover portion and the smaller of the stepped slots intersecting only the sidewall, respectively, the blower motor including at least one end frame having another end wall integral with another generally cylindric sidewall, a generally annular rabbet at least adjacent the another sidewall and generally opposite the another end wall, another opening in the another end wall, and a plurality of lugs integral with the another sidewall at least adjacent the annular rabbet and extending generally radially beyond the another sidewall, respectively, and a lock screw having a head portion thereon, the method comprising the steps of:

associating the blower motor with the cover and arranging the at least one end frame at least generally adjacent the distended section of the cover;

locating the lugs on the at least one end frame at least generally in vertical alignment with the larger stepped slots in the cover during the arranging step, respectively;

moving the blower motor toward the cover and positioning the at least one end frame at least in part within the distended section in response to the moving step;

placing the another end wall and sidewall on the at least one end frame at least adjacent the first named end wall and sidewall on the distended section during the positioning step, respectively;

passing the lugs on the at least one end frame into the larger stepped slots during the positioning step, respectively;

rotating the blower motor relative to the cover subsequent to the passing step;

displacing the lugs from the larger stepped slots into rotated positions in releasable engagement with the smaller stepped slots in response to the rotating step, respectively, thereby to releasably secure the blower motor to the cover;

aligning the elongate opening in the first named end wall at least in part with the another opening in the another end wall; and inserting the lock screw through the elongate opening into threaded engagement with the another opening in the another end wall and abutting the head portion of the lock screw with the first named end wall at least in part about the elongate opening thereby to retain the lugs against displacement from their respective rotated positions in releasable engagement with the smaller stepped slots.

2. A method of releasably securing a blower motor to a motor mounting part of a heat exchanging means, the blower motor having at least one end frame, the motor mounting part including a distended section having a sidewall and an end wall, and the sidewall of the distended section and the at least one end frame respectively including a set of means for interconnecting in releasable engagement with each other, a part of each interconnecting means of one of the interconnecting means sets extending through the motor mounting part adjacent the sidewall of the distended section, the method comprising the steps of:

inserting the interconnecting means of the other of the interconnecting means sets through the interconnecting means parts and beyond the motor mounting part and positioning the at least one end frame at least in part within the distended section at least adjacent the sidewall and end wall thereof upon occurrence of the inserting step; and rotating the blower motor relative to the motor mounting part with the at least part of the at least one end frame positioned within the distended section and respectively interconnecting the interconnecting means of the other interconnecting means set in releasable engagement with the interconnecting means of the one interconnecting means set in the sidewall of the distended section in response to the rotating step thereby to releasably secure the blower motor to the motor mounting part.

3. The method as set forth in claim 2 wherein the interconnecting means set comprises a set of stepped openings in the sidewall, each of the larger of the stepped openings extending in part through the motor mounting part thereby to comprise the interconnecting means parts, and the interconnecting means of the other interconnecting means set comprising a set of bayonet connectors on the at least one end frame, and wherein the inserting step includes passing the bayonet connectors into the larger stepped openings.

4. The method as set forth in claim 3 wherein the interconnecting step includes moving the bayonet connectors from the larger stepped openings into the smaller of the stepped openings and effecting the releasable engagement of the bayonet connectors with the smaller stepped openings in response to the moving step, respectively.

5. The method as set forth in claim 1 further comprising a lock screw, the motor mounting part further including an opening in the end wall, and wherein the method further comprises the additional steps of passing the lock screw through the opening into threaded engagement with the at least one end frame and abutting a part of the lock screw with the end wall at least in part about the opening therein.

6. A method of releasably securing a blower motor to a motor mounting part of a heat exchanging means, the motor mounting part including a distended section having an end wall spaced beyond a part of the motor mounting part and a generally cylindrical sidewall integrally interposed between the end wall and the part of the motor mounting part, a set of stepped openings in the sidewall with the larger of the stepped openings having parts thereof extending into the part of the motor mounting part adjacent the sidewall, respectively, the blower motor including at least one end frame, and a set of bayonet connectors on the at least one end frame extending generally radially therefrom, the method comprising the steps of:

moving the bayonet connectors beyond the part of the motor mounting part through the larger stepped opening parts and locating the bayonet connectors within the larger stepped openings in the sidewall, respectively; and rotating the blower motor in one direction relative to the motor mounting part and displacing the bayonet connectors from the larger stepped openings into releasable engagement with the smaller of the stepped openings in response to the rotating step, respectively, thereby to releasably secure the blower motor to the motor mounting part.

7. The method as set forth in claim 6 further comprising the additional step of interlocking the at least one end frame with the distended section and retaining the bayonet connectors against displacement rotation in another direction opposite the one direction from their releasable engagement with the smaller stepped openings, respectively, in response to the interlocking step.

8. The method as set forth in claim 6 wherein the moving step includes disposing the at least one end frame at least in part within the distended section and positioning the at least one end frame at least adjacent the end wall of the distended section.

9. The method as set forth in clam 8 wherein the cover further includes another opening in the end wall and wherein the method further comprises the additional step of inserting a lock screw through the another opening into threaded engagement with the at least one end frame and engaging a part of the lock screw with at least a part of the end wall extending about the another opening.

10. The method as set forth in claim 6 further comprising the preliminary step of aligning the bayonet connectors with the larger stepped openings, respectively.

11. A method of releasably securing a blower motor to a motor mounting part of a heat exchanger means the motor mounting part including a distended section having an end wall spaced from a part of the motor mounting part and a generally cylindric sidewall integrally interposed between the end wall and the part of the motor mounting part, a set of stepped openings in the sidewall with the larger of the stepped openings having parts thereof extending into the part of the motor mounting part adjacent the sidewall, respectively, the blower motor including at least one end frame, and a set of bayonet connectors on the at least one end frame, the method comprising the steps of:

positioning the at least one end frame on the blower motor at least in part within the distended portion of the motor mounting part and inserting the bayonet connectors on the at least one end frame through the larger stepped opening parts into the larger stepped openings in the sidewall in response to the positioning step, respectively;

rotating the blower motor and displacing the bayonet connectors from the larger stepped openings into releasable engagement with the smaller of the stepped openings in response to the rotating step, respectively, thereby to releasably secure the blower motor to the motor mounting part; and interlocking the at least one end frame and the distended section and retaining the bayonet connectors against displacement from their releasable engagements with the smaller stepped openings in response to the interlocking step, respectively.

12. The method as set forth in claim 11 further comprising the preliminay step of aligning the bayonet connectors at least in part with the larger stepped openings, respectively, and moving the blower motor toward the end wall.

13. The method as set forth in claim 11 wherein the motor mounting part further includes a pair of generally opposite faces with the distended section extending from the part of the motor mounting part in the direction of one of the opposite faces, and wherein the inserting step includes passing the bayonet connectors from adjacent the other of the opposite faces beyond the one opposite face at least at the part of the motor mounting part.

14. The method as set forth in claim 11 wherein the cover further includes another opening in the distended section, and wherein the interlocking step includes moving a lock screw through the another opening into threaded engagement with the at least one end frame and abutting a part of the lock screw with at least a part of the end wall extending about the another opening.

15. A method of releasably securing a blower motor to a motor mounting part of a heat exchanger means the motor mounting part including a set of stepped openings, the blower motor including at least one end frame, and a set of bayonet connectors on the at least one end frame, the method comprising the steps of:

passing the bayonet connectors in part through the larger of the stepped openings, respectively;

rotating the blower motor relative to the motor mounting part;

entering the bayonet connectors into the smaller of the stepped openings in response to the rotating step and receiving parts of the motor mounting part adjacent the smaller stepped openings in releasable gripper engagement between the bayonet connectors and the at least one end frame upon the occurrence of the entering step, respectively; and interlocking the motor mounting part and the at least one end frame thereby to obviate displacement rotation of the bayonet connectors from their respective gripping engagements with the motor mounting part.

16. The method as set forth in claim 15 further comprising the preliminary step of aligning the bayonet connectors with the larger stepped openings.

17. The method as set forth in claim 16 further comprising the further preliminary steps of moving the blower motor toward the motor mounting part to effect the passing step and seating at least parts of the at least one end frame arranged at least adjacent the bayonet connectors against the motor mounting part.

18. The method as set forth in claim 15 wherein the motor mounting part further includes another opening therein and wherein the interlocking step includes inserting a lock screw through the another opening into threaded engagement with the at least one end frame and abutting the lock screw against the motor mounting part about the another opening.

19. The method as set forth in claim 15 wherein the bayonet connectors each include a lip disposed in spaced relation with the at least one end frame and wherein the receiving step includes abutting the parts of the motor mounting part in the releasable gripping engagement between the lips and the at least one end frame, respectively.

20. The method as set forth in claim 15 wherein the motor mounting part includes a set of detents disposed in the parts of the motor mounting part, respectively, and wherein the receiving step includes engaging the detents with one of the bayonet connectors and the at least one end frame, respectively.

21. The method as set forth in claim 15 wherein the motor mounting part includes a set of lanced locking fingers extending at least in part generally angularly from the motor mounting part adjacent the smaller stepped openings, respectively, and wherein the interlocking step includes engaging the locking fingers with the bayonet connectors when the parts of the motor mounting part are received in the releasable gripping engagement between the bayonet connectors and the at least one end frame, respectively.

22. The method as set forth in claim 15 wherein the at least one end frame includes a set of flats arranged at least adjacent the bayonet connectors, respectively, and wherein the receiving step includes abutting the parts of the motor mounting part in the releasable grippingengagement with the flats, respectively.

23. A method of releasably securing a blower motor to a motor mounting part of a heat exchanger means the motor mounting part including a set of stepped openings, the blower motor including at least one end frame, and set of flats on the at least one end frame, a set of bayonet connectors extending generally axially beyond the at least one end frame and with the bayonet connectors having a set of lips arranged in overlaying spaced relation with the flats, respectively, the method comprising the steps of:

passing the bayonet connectors into the larger of the stepped openings and abutting the flats against the motor mounting part;

rotating the blower motor in one direction relative to the motor mounting part;

displacing the bayonet connectors from the larger stepped openings into the smaller stepped openings in response to the rotating step and gripping parts of the motor mounting part adjacent the smaller stepped openings in releasable engagement between the lips and the flats upon occurrence of the displacing step, respectively; and interconnecting the motor mounting part and the at least one end frame thereby to retain the blower motor against displacement rotation in another direction opposite the one direction.

24. The method as set forth in claim 23 wherein the motor mounting part further includes a set of detents at least adjacent the smaller stepped openings, respectively, and wherein the gripping step includes abutting the detents with one of the lips and the flats, respectively.

25. The method as set forth in claim 23 wherein the motor mounting part further includes a set of lanced locking fingers adjacent the smaller stepped openings, respectively, and wherein the interlocking step includes engaging the lanced locking fingers with the bayonet connectors, respectively.

26. The method as set forth in claim 23 further comprising a lock screw, and wherein the interconnecting step includes associating the lock screw in interlocking engagement with the motor mounting part and the at least one end frame.

27. An assembly for use with a housing of a unit for conditioning air comprising:

the housing including a motor mounting part having a distended section with an end wall and a generally cylindrical sidewall integrally interposed between said end wall and a part of said motor mounting part adjacent said sidewall, a set of stepped openings in said sidewall with the larger of said stepped openings extending in part into said part of said motor mounting part, and another opening extending through said end wall;

a blower motor including at least one end frame disposed at least in part within said distended section, another end wall on said at least one end frame disposed at least adjacent said first named end wall, another generally cylindric sidewall on said at least one end frame connected with said another end wall and disposed at least adjacent said first named sidewall, a set of lugs integrally with said at least one end frame and extending generally radially beyond said another sidewall, said lugs being passed through said larger stepped openings beyond said part of said motor mounting part and received in releasable engagement in the smaller of said stepped openings, respectively, thereby to releasably mount said blower motor to said motor mounting part; and a lock screw extending through said another opening into threaded engagement with said at least one end frame and having a head portion abutted in engagement with said motor mounting part about said another opening thereby to interlock said at least one frame and motor mounting part and retain said lugs against displacement from their respective releasable engagements with said smaller stepped openings.

28. An assembly for use with a housing of a unit for conditioning air comprising:

a housing motor mounting part including a distended section having an end wall spaced from a part of said housing motor mounting part and a sidewall interposed between said end wall and said part of said housing motor mounting part, and a set of stepped openings disposed at least in part in said sidewall;

a blower motor including at least one end frame disposed at least in part within said distended section, and a set of connector means on said at least one end frame and passed through the larger of said stepped openings for reception in releasable engagement in the smaller of said stepped openings thereby to releasably mount said blower motor to said housing motor mounting part, respectively; and means for interlocking in engagement between said distended section and said at least one end frame thereby to retain said connector means against displacement from their respective releasable engagements with said smaller stepped openings.

29. The assembly as set forth in claim 28 wherein said at least one end frame includes another end wall and another sidewall arranged at least adjacent said first named end wall and sidewall, respectively.

30. The assembly as set forth in claim 29 wherein said connector means comprise a set of lugs extending generally radially beyond said another sidewall and received in the releasable engagement in said smaller stepped openings, respectively.

31. The assembly as set forth in claim 28 wherein said interlocking means includes a lock screw extending through said end wall into threaded engagement with said at least one end frame and having a head portion engaged with said end wall.

32. An assembly for use with a housing of a unit for conditioning air comprising:

a housing motor mounting part having a set of stepped openings therein;

a blower motor including at least one end frame, a set of connector means on said at least one end frame and respectively passed through the larger of said stepped openings into the smaller of said stepped openings for releasably griping said housing motor mounting part in engagement between said connector means and said at least one end frame thereby to releasably mount said blower motor to said housing motor mounting part; and means arranged to interlock said housing motor mounting part and said blower motor for retaining said connector means against displacement from said smaller stepped openings.

33. The assembly as set forth in claim 32 wherein said housing motor mounting part further includes a set of detent means disposed at least adjacent said smaller stepped openings for engagement with respective parts of said connector means when said connector means are disposed in said smaller stepped openings.

34. The method as set forth in claim 32 wherein said retaining means include a set of lanced locking fingers extending at least in part generally angularly from said housing motor mounting part adjacent said smaller stepped openings and engaged with said connector means when said connector means are disposed in said smaller stepped openings, respectively.

35. The method as set forth in claim 32 wherein said retaining means includes a lock screw engaged with said at least one end frame and said housing motor mounting part.

36. The method as set forth in claim 32 wherein said at least one end frame includes a set of flats arranged at least adjacent said connector means, said connector means including a set of lips arranged in spaced apart overlying relation with said flats, and said housing motor mounting part being gripped in engagement between said lips and flats when said connector means are disposed in said smaller stepped openings, respectively.

37. The assembly a set forth in claim 32 wherein the housing motor mounting part includes a distended section defining an open ended recess, said stepped openings communicating at least in part with said open ended recess, and said at least one end frame being disposed at least in part within said open ended recess.

38. An outdoor unit for a central system for conditioning air comprising:

cabinet means for enclosing a plurality of components of the outdoor unit, said cabinet means comprising a base, a plurality of side panels mounted to said base with at least one of said side panels defining grill means for the passage of air therethrough, and a cover mounted on said side panels generally opposite said base and having another grill means for the passage of air therethrough, said cover including a generally annular rim connected with said another grill means, a generally central distended section having an end wall and a generally cylindric sidewall integrally interposed between said end wall and said annular rim, an opened ended recess defined within said end wall and said sidewall of said distended section, a plurality of stepped openings in said sidewall communicating with said open ended recess and with the larger of said stepped openings extending in part through said rim adjacent said sidewall, respectively, and another opening in said end wall spaced adjacent said sidewall;

a blower motor including a generally annular shell having a pair opposite facing rabbets, a pair of opposite end frames respectively seated against said opposite facing rabbets, a plurality of thrubolts extending through said shell and said end frame to retain said end frames seated against said rabbets, respectively, a rotatable shaft extending through one of said opposite end frames, the other of said opposite end frames being disposed at least in part within said open ended recess defined by said distended section of said cover, another end wall intersecting another generally cylindric sidewall on said other opposite end frame and disposed at least adjacent said first named end wall and said first named sidewall, respectively, a plurality of bayonet connectors integral with said other opposite end frame and extending generally radially beyond said another sidewall, respectively, said bayonet connector being passed through said larger stepped openings into rotated positions interconnected in releasable engagements with the smaller of said stepped openings thereby to releasably mount said blower motor to said cover, and a locking opening in said another end wall spaced adjacent said another sidewall and arranged in alignment with said another opening in said first named end wall of said distended section upon the releasable mounting of said blower motor to said cover;

a lock screw extending through said another opening in said first named end wall into threaded engagement with said locking opening in said another end wall and having a head portion abutted with said first named end wall at least in part about said another opening thereby to interlock said cover and said other opposite end frame of said blower motor and retain said bayonet connectors against displacement from their respective interconnections in releasable engagement with said smaller stepped openings; and fan means secured to said shaft of said blower motor and conjointly rotatable therewith for circulating ambient air through said first named grill means of said at least one side panel in heat exchange relation with at least some of said components within said cabinet means and expelling the circulated ambient air generally vertically upwardly through said another grill means in said cover upon the energization of said blower motor.

39. An outdoor unit for a central system for conditioning air comprising:

cabinet means for enclosing a plurality of components of the outdoor unit, said cabinet means including a cover having grill means therein for the passage of air, a distended section in a motor mounting part of said cover, and a set of stepped openings in said distended section;

a blower motor comprising one of said components and having at least one end frame enclosed at least in part within said distended section, said at least one frame including a set of connector means passed through the larger of said stepped openings into releasable engagement with the smaller of said stepped openings for releasably mounting said blower motor to said motor mounting part;

means for interlocking said blower motor and said motor mounting part thereby to retain said connector means against displacement from their respective releasable engagements with said smaller stepped openings; and fan means driven by said blower motor for circulating ambient air through said cabinet means in heat exchange relation with at least some of said components enclosed within said cabinet means and expelling the circulated ambient air from said cabinet means through said grill means in said cover.

40. The outdoor unit as set forth in claim 39 wherein said connector means comprise a plurality of bayonet connections passed through the larger of said stepped openings into the releasable engagements with the smaller of said stepped openings, respectively.

41. The outdoor unit as set forth in claim 39 wherein said at least one end frame further includes a plurality of flats disposed at least adjacent said connector means, and a plurality of lips on said connector means disposed in spaced overlaying relation with said flats, said flats and said lips being grippingly engaged with said cover at least adjacent said smaller stepped openings when said bayonet connectors are in their releasable engagements with said smaller stepped openings, respectively.

42. The outdoor unit as set forth in claim 41 wherein said distended section further includes a plurality of detent means arranged at least adjacent said smaller stepped, openings for abutting engagement with at least one of said connector means and said flats, respectively.

43. The outdoor unit as set forth in claim 40 wherein said interlocking means comprise a plurality of fingers lanced from said cover adjacent said smaller stepped openings, and a plurality of free ends on said fingers disposed to engage said connector means and prevent the displacement of said connector means from their releasable engagements with said smaller stepped openings, respectively.

44. The outdoor unit as set forth in claim 39 wherein said interlocking means comprises a lock screw interconnected between said cover and said at least one end frame.

45. The outdoor unit as set forth in claim 39 wherein said motor mounting part comprises a mounting bracket depending from said cover, said distended section being in said mounting bracket and including an end wall and a sidewall, said stepped openings being in said sidewall with the larger of said stepped openings extending in part into said mounting bracket adjacent said sidewall, and said at least one end frame having a set of bayonet connectors comprising said connector means.

46. The outdoor unit as set forth in claim 45 wherein said mounting bracket further includes another opening in said end wall, said blower motor further including a shaft extending through said at least one end frame and said another opening and connected in driving engagement with said fan means, and said fan means being disposed between said mounting bracket and said cover.

47. The outdoor unit as set forth in claim 39 wherein said motor mounting part includes an open ended recess within said distended section, and said at least one end frame being disposed at least in part within said open ended recess.

48. The outdoor unit as set forth in claim 47 wherein said distended section includes an end wall and a sidewall disposed about said open ended recess, said stepped openings being in said sidewalls and communicating with said open ended recess and with said larger stepped openings extending in part through said motor mounting part adjacent said sidewall, said at least one end frame having a plurality of bayonet connectors comprising said connector means, respectively.

* * * * *